US006351219B1

(12) United States Patent
Tanguay et al.

(10) Patent No.: US 6,351,219 B1
(45) Date of Patent: Feb. 26, 2002

(54) PHOTOELECTRIC SMOKE DETECTOR

(75) Inventors: William P. Tanguay, Downers Grove; Thomas W. Kondziolka, Chicago, both of IL (US)

(73) Assignee: Maple Chase Company, Downers Grove, IL (US)

( * ) Notice: Subject to any disclaimer, the term of this patent is extended or adjusted under 35 U.S.C. 154(b) by 0 days.

(21) Appl. No.: 09/608,049

(22) Filed: Jun. 30, 2000

(51) Int. Cl.[7] ..... G08B 7/10

(52) U.S. Cl. ..... 340/630; 340/628; 250/574; 356/438

(58) Field of Search ..... 340/630, 628; 250/574, 573; 356/337, 338, 438, 439

(56) References Cited

U.S. PATENT DOCUMENTS

| | | | | | |
|---|---|---|---|---|---|
| 4,316,184 | A | | 2/1982 | Nagel | 340/628 |
| 4,469,953 | A | * | 9/1984 | Fujisawa et al. | 250/574 |
| 4,471,346 | A | * | 9/1984 | Nelson et al. | 340/630 |
| 4,543,815 | A | * | 10/1985 | Troup et al. | 340/628 |
| 5,557,262 | A | | 9/1996 | Tice | 340/587 |
| 5,633,501 | A | | 5/1997 | Amleshi et al. | 250/381 |
| 6,057,774 | A | * | 5/2000 | Venzant | 340/630 |

* cited by examiner

*Primary Examiner*—Daniel J. Wu
(74) *Attorney, Agent, or Firm*—John M. England, Jr.; Terrence (Terry) Martin; Jules Jay Morris

(57) ABSTRACT

A photoelectric smoke detector includes a photoelectric chamber having a housing fabricated from an electrically conductive material.

9 Claims, 4 Drawing Sheets

PHOTOELECTRIC SMOKE DETECTOR

TECHNICAL FIELD

This invention relates to the field of smoke detectors, and more particularly to photoelectric type smoke detectors.

BACKGROUND ART

Smoke detectors are known safety appliances which are installed in various structures, including homes, office buildings, and warehouses, to monitor for the presence of smoke, and to provide an alarm in the event smoke is detected. The alarm may be audible and/or visual within the monitored space, and may be electronically communicated to a remote monitoring site.

While the performance feature offerings among different vendor model smoke detectors may vary, actual smoke detection is usually based on either an ionization or a photoelectric detection technology. Ionization smoke detectors are more sensitive than the photoelectric type detectors in detecting smaller particles of combustion, i.e. generally smaller than one micron (considered generally invisible to the human observer), which are predominately created by fast flaming fires. Alternatively, photoelectric smoke detectors are more sensitive than ionization detectors in detecting large combustion particulate, i.e. generally larger than one micron (considered to be visible to the human observer), which are created by smoldering fires. Common among both types of detectors, however, is that their chambers must be open to the environment, since they each measure the physical, not the gaseous, products of combustion.

The open chambers subject each type of smoke detector to ambient air quality conditions, including dust. Dust is a minor source of error for ionization detectors, which use a radioactive source to ionize the air molecules flowing into the chamber and an applied electric field to force the ionized air molecules to flow from the radioactive source to the detector's electrically conductive housing. The ionization detector's sensitivity is fixed by the geometry of the chamber and the internal sensing structure. However, dust and other similar physical debris more seriously affect the performance of photoelectric smoke detectors, which are optical devices.

Photoelectric detectors include an infrared (IR) light source and an IR photodiode receiver positioned at opposite ends of the detector's chamber. They are located off axis from each other to prevent the IR light source emitted energy from flowing directly to the receiver. Light absorbing baffles and coatings within the chamber are used to attenuate all quiescent state IR reflections, to provide a controlled, minimum value of photodiode current in the non-smoke state. In the event of a fire, combustion particles entering the detector's chamber disturb the quiescent state absorption characteristics, thereby producing IR scattering and causing IR energy to be detected by the photodiode. The photodiode responds by providing an output electrical current at a magnitude proportional to the detected IR, and when the current exceeds a selected threshold the detector sounds the alarm.

The magnitude of the output current provided by the photodiode is directly proportional to the intensity of the scattered IR it receives, which in turn is generally directly proportional to the density of the combustion particles entering the chamber. Using well established standards, the photoelectric detector's alarm threshold is correlated to a given level of smoke density by calibration to an associated magnitude of photodiode output current. With knowledge of the photoelectric detector's optical scattering characteristics and the offset tolerances of the IR source and photodiode, this calibration process ensures accurate, repeatable performance. Once installed, however, it is the ambient optical and electrical noise within the monitored space that sets a "noise floor" within the chamber, which manifests itself in terms of a quiescent "offset" current at the photodiode output.

The photoelectric chamber of prior art photoelectric smoke detectors is made of plastic, which may be injection molded into the fine details required in the chamber structure. Due to the presence of the active IR source and photodiode within it, the plastic material is also dielectric, to prevent the possibility of electrical shorting of the electrical component leads to the case. The dielectric material is therefore an insulator, which prevents electron flow through it.

As normally occurring air currents flow into the chamber, the friction of the air molecules across the interior surfaces of the chamber's dielectric material housing induces an electrostatic charge in the housing through the known triboelectric effect. This electrostatic charged surface is capable of attracting and holding dust fibers and similar microscopic debris flowing near its surface. In effect, this dielectric material chamber functions in a manner similar to an electrostatic air collector, or filter.

As dust particles enter the photoelectric chamber and settle on or are attracted to its internal surfaces, they build up a coating which modifies and in time alters the light absorbing properties of the black surfaces of the inner surfaces of the chamber housing walls. This in turn alters the chamber's absorption and scattering characteristics, resulting in scattered IR energy being reflected back to the photodiode as noise in either the clean air state or during smoke conditions. As the surface dust levels build, the noise increases, decreasing the detector's signal-to-noise ratio. Since the alarm threshold is calibrated to a given level of receiver signal magnitude, the signal build-up due to the additional noise effectively decreases the concentration of combustion particulate necessary to establish an alarm condition. This may result in the sounding of false, or premature alarms.

It is for these reasons that manufacturers of photoelectric smoke detectors recommend that the detector, including the photoelectric chamber, be kept as clean as possible by periodic cleaning to remove the dust build-up. This includes either washing and/or vacuuming the chamber. However, due to the unobtrusive nature of the detector this maintenance cleaning is often forgotten. This is especially true in residential applications where there are no established maintenance regimes, as there may be in industrial applications. It is desirable, therefore, to provide a photoelectric detector in which the effect of dust build-up on detector performance is minimized.

DISCLOSURE OF INVENTION

One object of the present invention is to provide a photoelectric smoke detector which is dust tolerant in its performance characteristics. Another object of the present invention is to provide a photoelectric smoke detector with lower maintenance requirements. Still another object of the present invention is to provide a photoelectric smoke detector with higher reliability performance.

According to the present invention, a photoelectric smoke detector for monitoring the ambient air within a space, includes an assembly having a base unit and a cover unit adapted to releasably engage each other to form an enclosure which is capable of receiving therein the ambient air of the selected space, the photoelectric smoke detector further including a voltage signal source and a photoelectric chamber disposed within the enclosure, the chamber having a housing comprising an electrically conductive material, with a plurality of baffles disposed along a surface thereof to permit ambient air to enter the chamber without inducing an electrostatic charge in the housing, the chamber further having disposed therein a light source for emitting light energy and a light receiver for providing an output signal at a signal magnitude which is proportionate to the intensity of its received light, the light source, the light receiver, and the baffles being arranged within the chamber housing to provide a minimum magnitude output signal in a quiescent state identified as the absence of constituents of combustion in the ambient air.

In further accord with the invention, the electrically conductive material housing of the photoelectric chamber comprises a metal. In still further accord with the present invention, the chamber housing material is of a conductive thermoplastic material comprising a chemical compound of plastic resins and one or more of a variety of conductive filler materials. In yet still further accord with the present invention, the conductive filer material is selected from among the group consisting of carbon black, carbon fiber, metal fiber, metal-coated carbon fiber, and metal powders.

These and other objects, features, and advantages of the present invention will become more apparent in light of the following detailed description of a best mode embodiment thereof, as illustrated in the accompanying Drawing.

BEST MODE FOR CARRYING OUT THE INVENTION

Figure 1:
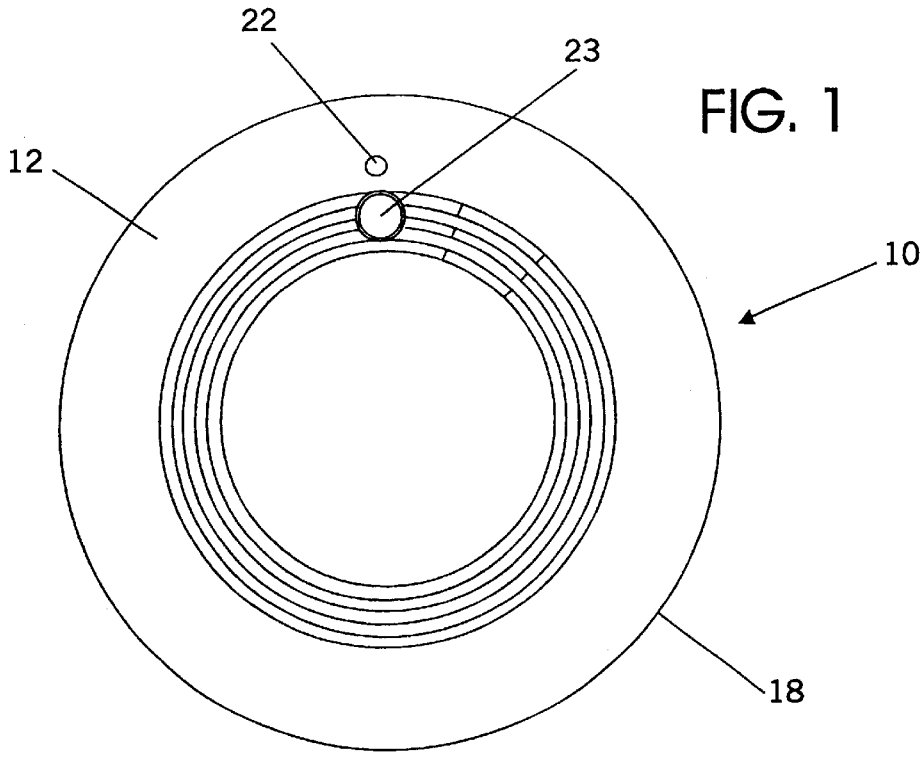
FIG. 1, is a plan view of an assembled photoelectric smoke detector of the type in which the present invention may be used.
Figure 2:
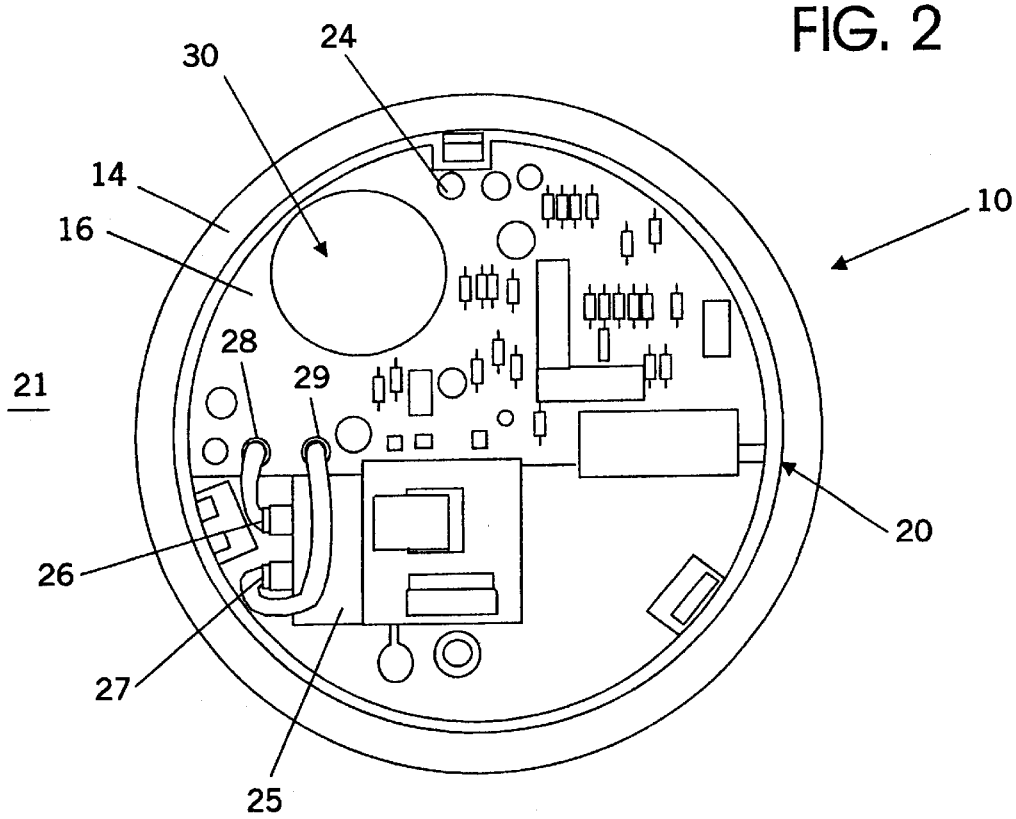
FIG. 2, is a plan view of a partial disassembly of the smoke detector of FIG. 1, illustrating the detector's major elements, including the detector's photoelectric chamber.

Referring simultaneously to FIGS. 1 and 2, in generalized plan views of a photoelectric detector assembly 10 in which the present invention may be used, the assembly 10 includes a protective cover 12, which is adapted to releasably engage a base element 14 to provide an enclosure which provides protective covering of circuit elements mounted to a circuit board 16 within the base 14. As known, although not evident in FIGS. 1 or 2, the diameter of the cover 12 is greater than that of the base 14 to provide openings along the mating perimeter of the underside 18 of the cover 12 and the perimeter 20 of the base 14, to permit ambient airflow from the monitored space 21 to the surface of the circuit board 16.

Additional smoke detector features illustrated on the cover 12 include a visual annunciator 22 which provides an indication of applied AC power, and a PUSH TO TEST switch 23 which allows an operator to test operability of the smoke detector. In the illustrated embodiment the test switch button is transparent and utilizes the function of a light pipe to convey the alarm annunciation of a visible alarm annunciator 24 (FIG. 2). Electrical power to the smoke detector may be provided through connection to the commercial AC electrical distribution system of the installed space (not shown), or through a battery source 25, or by both connection to the electrical distribution system and by battery. In the best mode embodiment the battery is 9.0 VDC, and is of a known type, such as carbon zinc, zinc chloride, alkaline, or lithium. The battery has a high potential (or positive) voltage terminal 26 and a low potential (or negative) voltage terminal 27, which are shown connected through suitable electrical connectors to high potential and low potential terminals 28, 29 on the circuit board 16.

The circuit board 16 includes a photoelectric chamber 30 mounted thereon together with circuit elements which are shown generally, to provide a visual reference of the arrangement of chamber 30 and the other circuit elements on the board 16. These circuit elements represent known type components arranged in known circuit configurations to perform known functional tasks in prior art photoelectric smoke detectors. The novelty of the present photoelectric smoke detector over prior art devices is in the photoelectric chamber 30.

Figure 3:
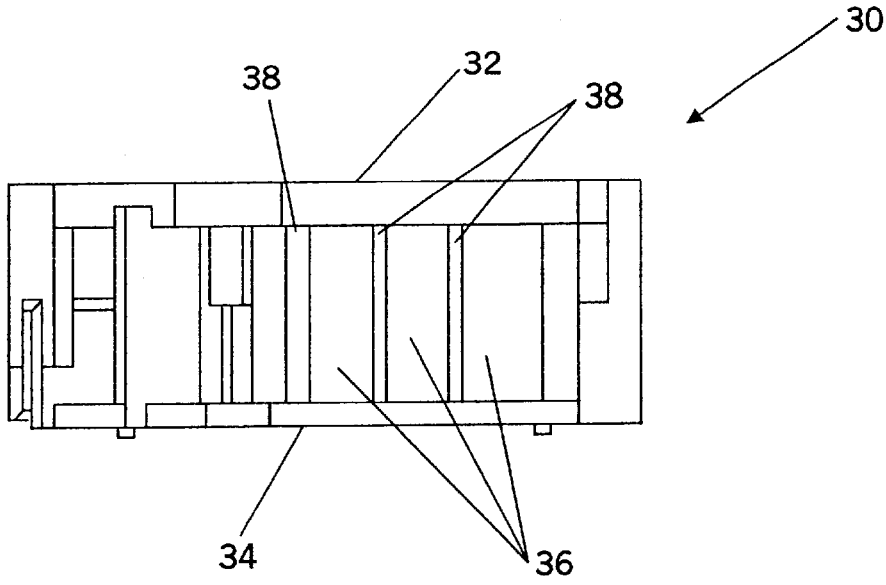
FIG. 3, is an elevation view of an assembled photoelectric detector chamber according to the present invention, as may be used in the photoelectric smoke detector of FIGS. 1 and 2.
Figure 4:
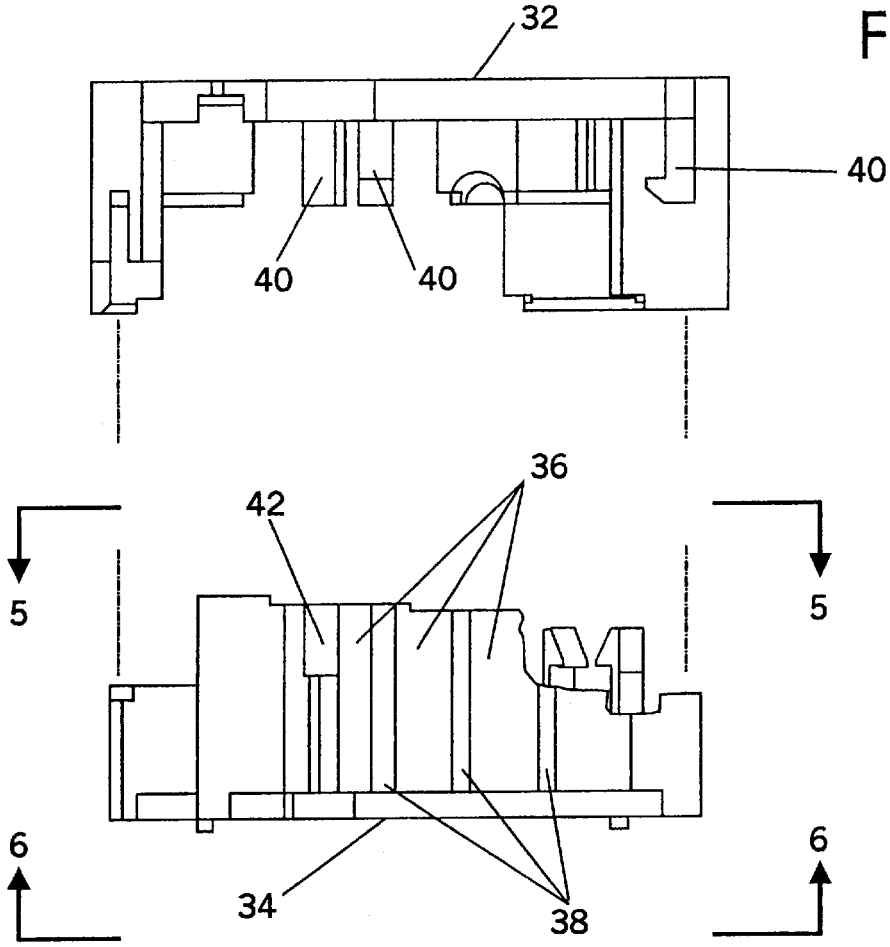
FIG. 4, is an exploded elevation view of the photoelectric chamber of FIG. 3.
Figure 5:
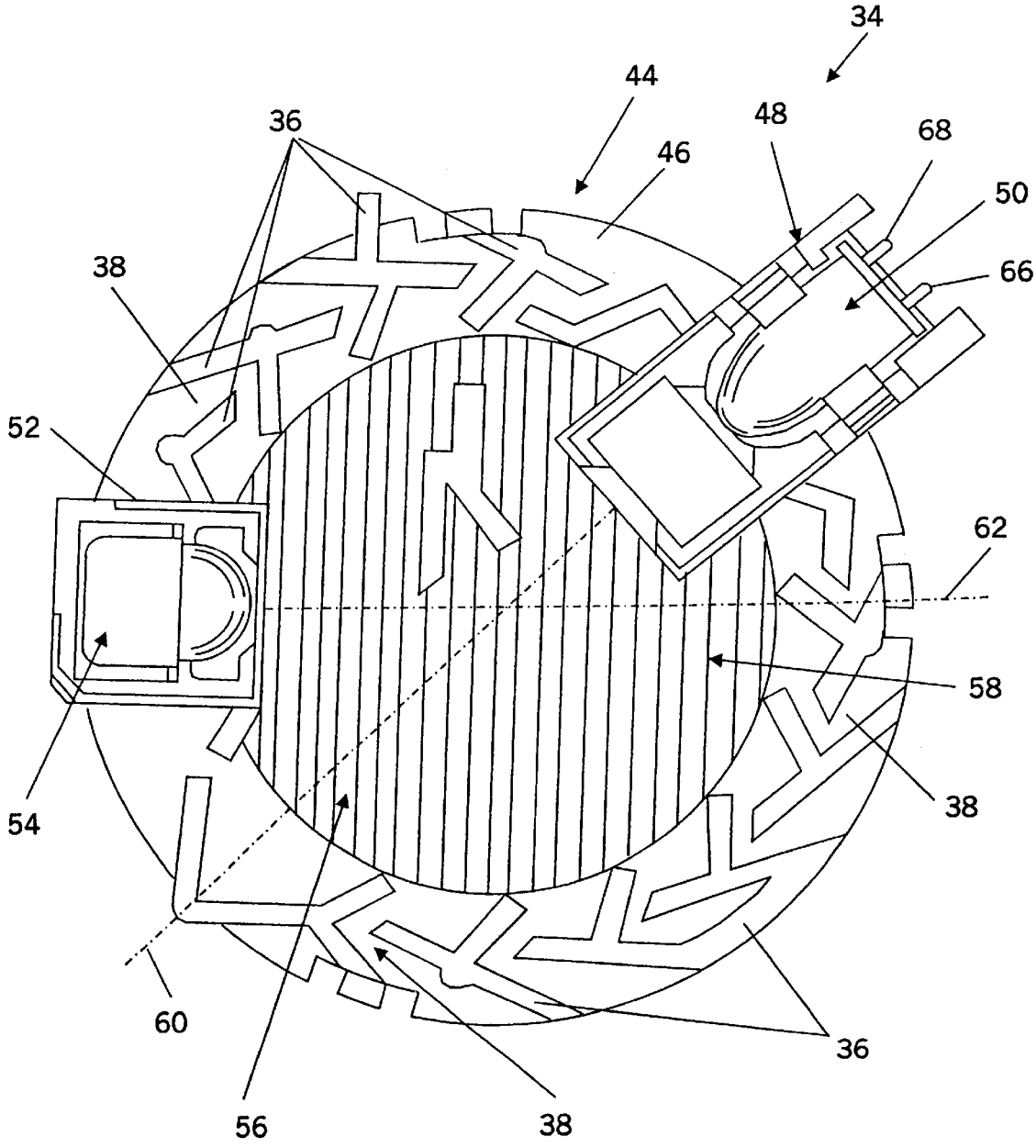
FIG. 5, is a plan view taken along the line 5—5 of FIG. 4.
Figure 6:
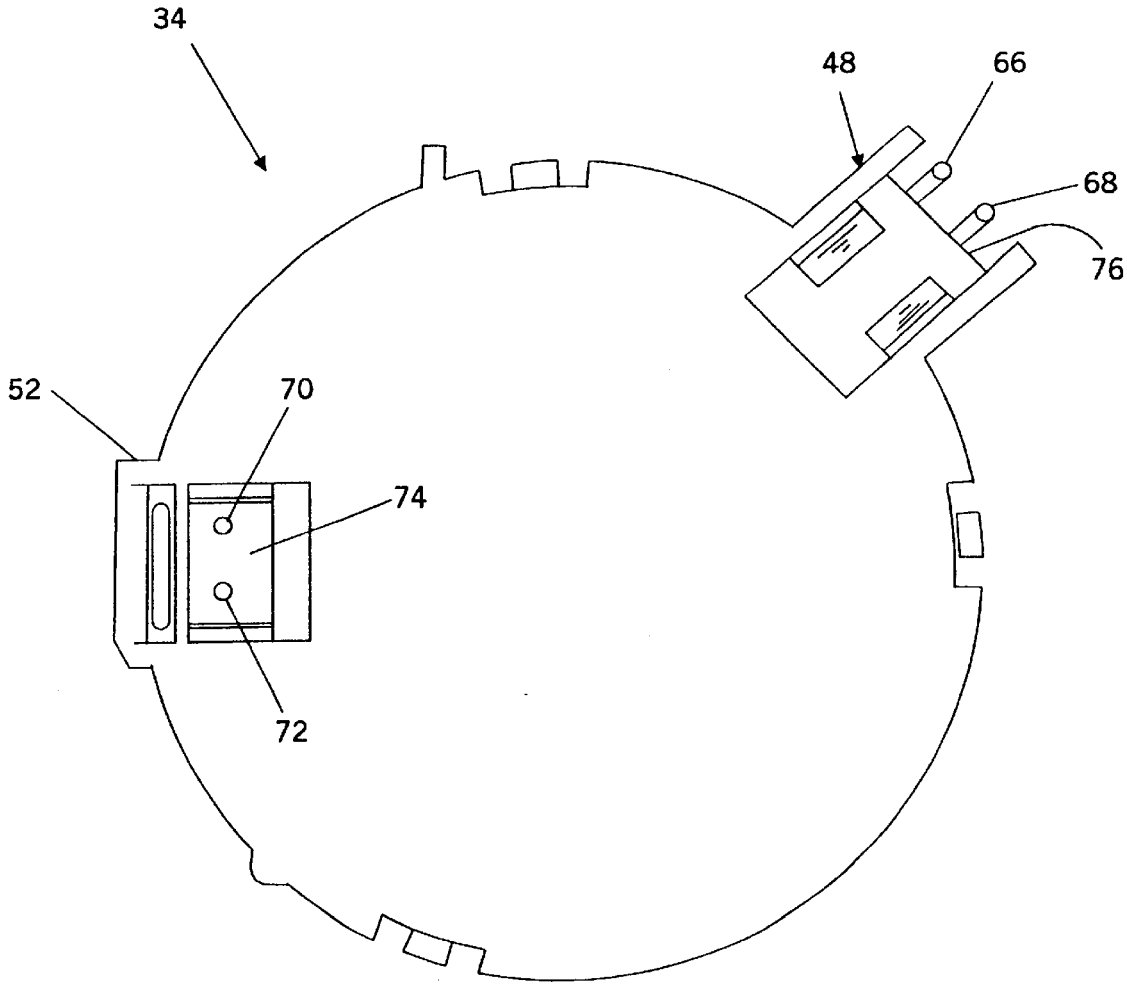
FIG. 6, is a plan view taken along the line 6—6 of FIG. 4.

To provide referential features of the photoelectric chamber, FIGS. 3–6 illustrate the chamber in different stages of disassembly. FIG. 3 is a side elevation of the assembled chamber 30 which, as shown in FIGS. 5, 6, is generally circular. As shown more clearly in the disassembled view of FIG. 4, in the best mode embodiment the chamber housing comprises a cover portion 32 and base portion 34. There are a series of baffles 36 arranged along the perimeter of the chamber, as shown more clearly in FIG. 5. Passages 38 (shown in stipple for illustrative clarity) formed intermediate of the baffles permit ambient air at the surface of the circuit board 16 to flow into the chamber's interior.

FIG. 4 illustrates the disassembly of the chamber 30 into its constituent cover portion 32 and base portion 34. The two portions are designed to releasably engage and disengage through the use of tensioned clip wands 40 located in the cover portion and their mating surfaces 42 (only one shown in the view) located in the base portion. This ease of disassembly allows ready access to the IR light source and photodiode.

FIG. 5 is a plan view of the internal surface 44 of the base portion 34. In this view the baffles 36 (FIG. 3) are readily apparent, and are positioned in a radial band 46 which extends along the circumference of the base portion in all but those areas which are occupied by the mounting platform 48 for the IR source 50 and the mounting platform 52 for the photodiode 54. The baffles block direct light from entering the interior of the chamber, but do provide the intermediate airflow passages 38 (FIG. 3) which allow ambient air to flow from the area above the printed circuit board 16 (FIG. 2) to the internal surface 44 of the photoelectric chamber. The baffles are also sized to meet the requirements for Underwriters Laboratories standard UL217 with regard to insect infestation.

The internal surface 44 is light absorbing, and in a best mode embodiment comprises a plurality of light absorbing channels 56 spaced intermediate to a plurality of rib-like elements 58 that are disposed on the interior surface, inward from the radial band 46. The light absorbing channels are a part of the optical characteristics of the chamber, which provide for a specific minimum value of reflected light in the quiescent state. Similarly, the IR source 50 emits IR energy along a boresight 60, which is substantially offset from the sightline 62 of the photodiode 54. A centrally placed baffle 64 blocks any stray light emitted by the source 50 from being received directly by the photodiode receiver 54. In a best mode embodiment the IR source 50 is an IR light emitting diode (LED), however, other type IR sources may also be used. In general, the IR source 50 and photodiode 54 may be any of a number of known type devices that are deemed suitable by those skilled in the art for use in smoke detector applications.

In the present invention, in contrast to the prior art photoelectric smoke detectors, the photoelectric chamber 30 comprises an electrically conductive material housing. This electrically conductive housing is not susceptible to the triboelectric effect and cannot, therefore, develop an electrostatic charge due to molecular friction of the air molecules passing along its surface. As a result, dust build-up, and its performance degrading effect, is reduced. Therefore, the present photoelectric smoke detector maintains a relatively constant background signal level over the life of the chamber, resulting in a consistent signal-to-noise performance of the chamber.

The housing material may be of any electrically conductive type having suitable conductivity, surface finish, and light absorbing properties. This may include various type plastics, as well as various type metals. The material selection, however, must consider the workability of the material to provide the chamber's necessary optical details. In a best mode embodiment, therefore, the chamber comprises a conductive thermoplastic material capable of being injection molded into the cover and base portions 32, 34 (FIGS. 3–4) with all of their required detailed optical and mechanical features. The use of conductive plastic allows for creation of the fine mechanical detail that would otherwise be difficult and more costly with metal processing techniques.

While thermoplastic itself is generally a dielectric material, conductive thermoplastics are known compounds of plastic resins and one or more of a variety of conductive filler materials, such as carbon black, carbon fiber, metal fiber, metal-coated carbon fiber, and metal powders, such as those compounds manufactured by the RTP Company, Winona, Minn., under their Imagineering Plastics® trademark. The conductive thermoplastic material is capable of protecting against electrostatic charge build-up. In the best mode embodiment, the conductive thermoplastic material of the photoelectric chamber housing comprises the RTP Company series ESD C 600 ABS (acrylonitrile butadiene styrene) black-colored thermoplastic. The electrically conductive photoelectric chamber is extremely effective in preventing dust build-up within the chamber. Without an electrostatically charged surface, dust and other physical contaminants are not attracted to the chamber housing walls. With the conductive thermoplastic chamber, the interior surfaces of the chamber may have to be suitably polished to provide the required degree of reflectivity, since the material's carbon content may itself produce a duller, less reflective surface. Polishing, however, results in excellent background signal and smoke signal performance of the chamber. It maintains a relatively constant background signal level over the life of the chamber, resulting in a consistent signal-to-noise performance of the chamber.

The use of conductive thermoplastic also requires that care be taken to ensure that there is not electrical shorting of the electrical leads 66, 68 (FIGS. 5 and 6) of the IR light emitting diode 50 and the electrical leads 70, 72 (FIG. 6) photodiode 54 to the housing. Therefore, these elements are designed to be robustly constrained within their mountings to keep their electrical leads away from the housing surfaces. As shown in FIG. 6, which is the side of the base portion 34 that is opposite the internal surface 44, in the best mode embodiment the electrical leads 70, 72 of the photodiode are positioned within a space 74 formed in the base 34, thereby positioning the leads well away from the conductive housing. Similarly, the leads 66, 68 of the light emitting diode 50 extend well beyond the edge 76 of the diode mounting platform 48.

As known to those skilled in the smoke detector arts, ionization smoke detectors do use electrically conductive material chambers. The materials include both metals and conductive thermoplastic compounds. However, there the chamber housing is an integral path element of the ionized current flowing between the housing and the radioactive source, as well as serving as an electrical shield for the extremely sensitive central electrode of ionization smoke alarm chambers. It must be electrically conductive to satisfy the ionization protocol requirements, i.e. accommodate a current flow, or the detector cannot function. This of course is not the situation with the photoelectric type smoke detector, which is an optical device, and which does not require active current flow through the housing. In other words, the use of an electrically conductive housing in the present photoelectric detector is for an entirely unrelated purpose; that of eliminating the problems associated with the triboelectric effect in electrostatically charging the housing. This in turn, minimizes the sensitivity of the photoelectric smoke detector to ambient dust conditions.

As mentioned earlier, although it is less practical to mass-produce photoelectric chambers from metal, due to the myriad complex surfaces within the chamber, metal would be very effective in this application. As with the conductive thermoplastic, the metal would eliminate electrostatic charging of the housing and mininmize, if not eliminate, the build-up of dust particles on the chamber interior surfaces. The interior metal housing surfaces would also be coated with a suitable black color to provide the appropriate reflecting qualities. Once again, however, the use of conductive thermoplastic is preferred since it easily allows for the creation of the fine mechanical details required within the chamber. It clearly provides a manufacturing advantage.

Although the invention has been shown and described with respect to a best mode embodiment thereof, it should be understood by those skilled in the art that various changes, omissions, and additions may be made to the form and detail of the disclosed embodiment without departing from the spirit and scope of the invention, as recited in the following claims.

We claim:

1. A photoelectric smoke detector, for detecting the presence of smoke in the ambient air of a monitored space, comprising:

a base unit, adapted for installation within the monitored space;

a cover unit, adapted to releasably engage said base unit to form an enclosure which receives therein the ambient air of the monitored space; and a photoelectric chamber, disposed within said base unit, and having a housing with a plurality of baffles disposed along a surface thereof to permit ambient air to enter the interior of said housing, said chamber having disposed therein a light source for emitting light energy and a light receiver for providing an output signal at a signal magnitude proportional to the intensity of the light received, the light source, the light receiver, and the baffles being arranged within the chamber housing to provide a minimum magnitude output signal in a quiescent state associated with the absence of smoke in the ambient air;

as characterized by:

said photoelectric chamber housing comprising an electrically conductive material, which permits the flow of ambient air through said baffles without inducing an electrostatic charge in the housing.

2. The photoelectric smoke detector of claim 1, wherein the said electrically conductive photoelectric chamber housing material comprises a metal.

3. The photoelectric smoke detector of claim 1, wherein the said electrically conductive photoelectric chamber housing material comprises a conductive thermoplastic.

4. The photoelectric smoke detector of claim 3, wherein said conductive thermoplastic comprises a chemical compound of plastic resins and one or more electrically conductive filler materials.

5. The photoelectric smoke detector of claim 4, where the plastic resin is acrylonitrile butadiene styrene.

6. The photoelectric smoke detector of claim 4, wherein said electrically conductive filler material is selected from among the group consisting of carbon black, carbon fiber, metal fiber, metal-coated carbon fiber, and metal powders.

7. The photoelectric smoke detector of claim 4, wherein said conductive thermoplastic comprises series ESD C 600 ABS thermoplastic.

8. The photoelectric smoke detector of claim 1, wherein the light source is a light emitting diode.

9. The photoelectric smoke detector of claim 1, wherein the light receiver is a photodiode.

* * * * *